United States Patent [19]

Bauer

[11] 4,407,538

[45] Oct. 4, 1983

[54] BISTABLE LATCH

[76] Inventor: Peter Bauer, 13921 Esworthy Rd., Germantown, Md. 20767

[21] Appl. No.: 227,731

[22] Filed: Jan. 23, 1981

[51] Int. Cl.[3] ..... E05C 19/06

[52] U.S. Cl. ..... 292/87

[58] Field of Search ..... 292/87, 76, DIG. 49, 292/DIG. 66, 80, 81; 24/163, 198, 199, 201, 203

[56] References Cited

U.S. PATENT DOCUMENTS

| | | | |
|---|---|---|---|
| 1,388,495 | 8/1921 | Vilandrer | 24/201 HH X |
| 1,988,345 | 1/1935 | Vaughn | 74/100 |
| 3,466,076 | 9/1969 | Bishing | 292/DIG. 49 |
| 4,165,359 | 8/1979 | Thomas et al. | 292/DIG. 66 |
| 4,284,299 | 8/1981 | Kelly | 292/87 |

FOREIGN PATENT DOCUMENTS

| | | | |
|---|---|---|---|
| 639136 | 4/1962 | Canada | 292/87 |
| 2730913 | 8/1977 | Fed. Rep. of Germany | 292/87 |

*Primary Examiner*—Richard E. Moore

*Attorney, Agent, or Firm*—Griffin, Branigan & Butler

[57] ABSTRACT

A latch mechanism useful for belt buckles, door latches, etc., includes an endless member in the form of a frusto-conical or frusto-spherical band of spring-like material which can be snapped between two stable positions. In one position the rim of the band is disposed on one side of a reference plane defined by the outer rim; in the other position the inner rim is on the opposite side of that plane. An integral tongue projects from one rim of the band and is positionally slaved thereto to assume first and second orientations depending upon the band position. The band is secured to one of two members to be latched, the second member having a keeper for receiving the tongue and a portion of the band, precluding relative movement between the two members. A keeper surface abuts the distal edge of the tongue in one stable band position such that movement of the band out of the keeper is resisted by the abutting force of the surface applied longitudinally to the tongue. When the band is snapped to its second position it can be slid out of the keeper along the reference plane. Belt buckle and door latch embodiments are disclosed.

11 Claims, 12 Drawing Figures

BISTABLE LATCH

TECHNICAL FIELD

The present invention relates to improved latching arrangements which are particularly useful for belt buckles and door latches.

BACKGROUND OF THE INVENTION

It is a primary object of the present invention to provide a latching method and apparatus which utilizes lightweight and inexpensive components, is simple to operate while providing positive latching action, and is capable of repeated operation without breakage. It is a more specific object of the present invention to provide an improved belt buckle utilizing a novel latching arrangement which is particularly advantageous for safety seat belts. It is another object of the present invention to provide an improved door latch.

SUMMARY OF THE INVENTION

The latching mechanism of the present invention is based upon the positional bistability of an endless band of spring-like material such as spring steel, plastic, etc., which is formed in a frusto-conical or frusto-spherical configuration. The endless band has an inner rim, surrounding a cut-out area, and an outer rim which defines a reference plane. The band can be snapped between two stable positions wherein the inner rim resides on opposite sides, respectively, of the reference plane. A latching tongue is formed integrally with and projects from the endless band. The latching tongue has two stable orientations relative to the reference plane, corresponding to the two stable band positions. The distal end of the latching tongue abuts and clears a latch surface in the two stable tongue orientations.

In a belt buckle embodiment, the endless band is secured to one end of a belt. The other end of the belt is secured to a keeper in the form of a shallow hollow housing having one open end for receiving a portion of the body member and the latching tongue. When the tongue is inside the housing its distal end projects back toward the open end of the housing which includes a lip extending transversely across the open end. In the latched position of the endless band, the distal edge of the latching tongue abuts the lip and prevents removal of the band from the housing. Specifically, attempts at removal of the band result in a resistive force applied longitudinally of the tongue by the lip at the distal edge of the tongue. If the band is snapped to its open position, the distal edge of the tongue clears the lip to permit unfettered removal of the band from the housing.

In a door latch embodiment, the endless band is secured to either the door member or the jamb member with a keeper being secured to the other member. The keeper includes a surface which abuts the distal edge of the tongue when the door is closed, the body member is inserted partially into the keeper, and the band is in its latched position. The abutting distal tongue edge and keeper surface block removal of the band from the keeper, and the presence of the band in the keeper precludes opening of the door. When the band is snapped to its unlatched position, the distal tongue edge is moved out of abutting relation with the keeper surface, thereby permitting the band to be removed from the keeper and the door to be opened.

In each embodiment, the tongue abuts the keeper surface or lip, as the case may be, in a substantially perpendicular orientation so that any attempt to force the latch without switching the band position results in a resistive force being applied longitudinally through the tongue to the band by the keeper surface or lip. This longitudinal force can overcome the latching action only if the tongue buckles. Buckle-resistance of spring steel, plastic and other materials of which the tongue and band can be made is much greater than resistance to deformation from bending forces applied in other directions.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein.

DESCRIPTION OF THE PREFERRED EMBODIMENTS

Figure 1:
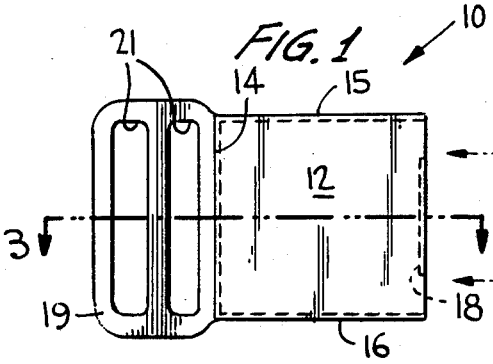
FIG. 1 is a view in plan of a housing portion of a belt buckle constructed in accordance with the present invention.
Figure 2:
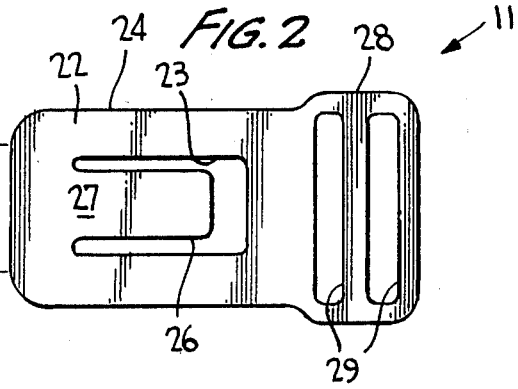
FIG. 2 is a view in plan of a latch portion of the belt buckle partially illustrated in FIG. 1.

Referring more specifically to FIGS. 1–6, a belt buckle according to the present invention includes a housing 10 and latching member 11. Housing member 10 takes the form of a rectangular box having a length and a width which are greater than its depth. Specifically, housing 10 has rectangular top and bottom walls 12 and 13, respectively, which are substantially larger in area than its rear wall 14 and side walls 15 and 16. The forward end of housing 10 is open at 17 along its entire width and is provided with a lip which projects from bottom wall 13 toward top wall 12 while extending transversely across a portion of the opening. The rear wall 14 is secured to a connecting member 19 having one or more loops 21 defined therein for engaging one end of a belt (not shown). In the illustrated embodiment, housing 10 is shown as being fabricated by a first flat member, incorporating top wall 12 and the top portion of connecting member 19, which is joined to a second member incorporating bottom wall 13, rear wall 14, side walls 15 and 16 and lip 13 as well as a bottom portion of connecting member 19. Alternatively, the housing 10 may be a single member bent back on itself or a plurality of members wherein connecting member 19 is not formed from a single piece with the housing. The entire housing and connecting member may be metal, plastic or similar material.

Latching member 11 includes an endless band 22 of thin spring-like material such as spring steel, spring brass, plastic or similar material capable of functioning in the manner described herein. Endless band 22 is a frusto-conical or frusto-spherical section having an inner rim 23 and an outer rim 24 of generally rectangular configuration. Inner rim 23 surrounds a cut-out region. An elongated latching tongue 26 projects from a root portion 27 thereof which joins inner rim 23 at a location on a shorter dimension of the band corresponding to the forward end of the band. In the preferred embodiment, tongue 26 is a co-planar extension of band 22 and has a projection in the plane of inner rim 23 which is somewhat smaller than the cut-out area defined by that rim. The rearward end of the band 22 is secured to a connecting member 28 having one or more loops 29 defined therein for engaging the opposite end of the belt (not shown). Band 22 and connecting member 28 are illustrated as being formed as a single piece; this is not a necessary limitation on the present invention.

Latching member 11 has two stable positions relative to outer rim 24 such as described in U.S. Pat. No. 1,988,345 to Vaughn. In one such position (i.e. the latching position illustrated in FIGS. 4 and 6), the endless band 22 is on one side of rim 24 (i.e. the bottom side as viewed in FIGS. 4 and 6). In the other position (i.e. the open position illustrated in FIG. 5), the endless band 22 is disposed on the opposite side (i.e. the top side as viewed in FIG. 5) of rim 24. Latching tongue 26, being integral with endless band 22, is positionally slaved thereto and likewise has two orientations relative to rim 24 corresponding to the two stable positions of member 11.

Figure 4:
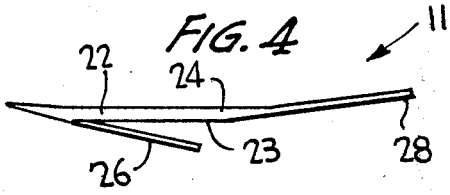
FIG. 4 is a side view of the latch portion of FIG. 2.

The width of latching member 11 (i.e. the top to bottom dimension in FIG. 2) is such to permit the forward portion of member 11 to be slidably received in housing member 10, at least up to the free or distal end of tongue 26. The thickness of latching member 11 (i.e. the vertical distance between rim 23 and rim 24 as seen in FIG. 4) is considerably less than the depth of housing 10 to permit the housing to receive member 11 as aforesaid.

Figure 5:
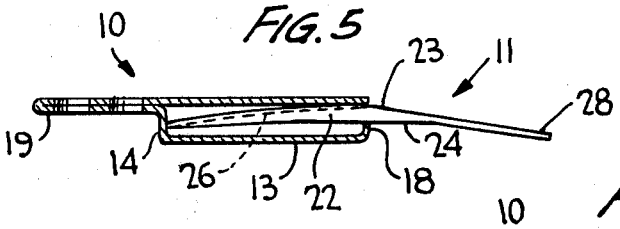
FIG. 5 is a side view in partial section showing the latch portion of the belt in the housing portion with the belt unlatched.
Figure 6:
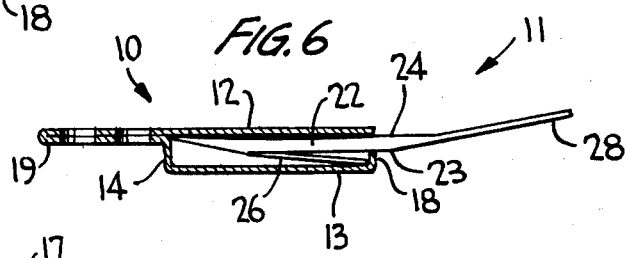
FIG. 6 is a view similar to that of FIG. 5 with the belt shown latched.

In operation, the two stable positions of latching member 11, when inserted in housing member 10, correspond to an open condition, as illustrated in FIG. 5, and a latched position as illustrated in FIG. 6. If it is assumed that the latching member 11 is initially inserted into the housing member 10 in the open condition (FIG. 5), tongue 26 is seen to be oriented with its distal or free end directed toward or abutting top housing wall 12. Depending upon the particular tongue configuration, the resiliently biased tongue may abut wall 12 with sufficient force to urge rim 24 against lip 18; however, this in no way interferes with removal of latching member 11 from housing member 10 by pulling on the two members in opposite directions. Importantly, in this open position of the buckle, the distal or free end of tongue 26 does not engage lip 18 and readily clears that lip when the members 10 and 11 are pulled apart.

In the latched condition of the buckle (FIG. 6), the free or distal end of tongue 26 abuts lip 18 and prevents removal of latching member 11 from housing member 10. In this position, rim 24 abuts top wall 12 of housing member 10 so that there is no slack in the vertical direction as illustrated in FIG. 6. In fact, it is preferable that this vertical dimension of latching member 11, if not constrained by housing member 10, is slightly greater than the spacing between housing walls 12 and 13. Under such conditions, the housing wall 13 acts to bend the resilient tongue and the latching member is afforded no slack or space within which to move vertically as seen in FIG. 6.

Switching of the latching member 11 between its two stable positions is achieved in a similar manner to that described in the aforementioned Vaughn patent. For example, if the buckle is latched as in FIG. 6, the wearer would push or pull down (as viewed in FIG. 6) on connecting member 28. This results in the mid-portion of band 22 moving downward until it abuts lip 18 and/or bottom wall 13 which exerts an opposing upward force on this mid-portion of the band. Wall 13 also exerts an upward force on tongue 26. The forward end of band 22 experiences a downward reactive force by wall 12, with the result that the spring metal or plastic band 22 experiences net bending forces transversely about its longitudinal mid-portion. The band snaps to its open position (FIG. 5) under these conditions, whereby tongue 26 clears lip 18 to permit removal of the latch member 11 from housing member 10. Switching from the open condition to the latched condition proceeds in a similar manner with upward force (FIG. 5) being exerted on connecting member 28, resulting in an upward force by wall 13 on the forward end of band 22 and a downward force on tongue 26 and the mid-portion of band 22 by wall 12.

It is preferable that the interior distance between wall 14 and lip 18 in housing member 10 be the same as the longitudinal distance between the forward tip of rim 24 and the free or distal end of tongue 26 of latching member 11. This precludes longitudinal slack space for the latch member in the latched condition.

It is also preferable that tongue 26 abut lip 28 in a substantially perpendicular intersection, thereby assuring that the lip applies its reactive force substantially longitudinally along tongue 26. Specifically, with reference to FIG. 6, attempts to separate the latching and housing members by withdrawing the latching member from the housing will be opposed by a reactive force applied to the distal end of tongue 26 by lip 18. If this reactive force is applied longitudinally of the tongue, the tongue must buckle before the latching action can be overcome by force. As with most rigid materials, the spring steel, plastic, etc., used for member 11 is much more resistant to buckling than to transverse bending, torsion, etc. On the other hand, to the extent that the intersection between tongue 26 and lip 18 varies from perpendicular, a transverse bending component is introduced into the reactive force applied to the distal end of the tongue by lip 18. Therefore, the closer to perpendicular that one can design the intersection between tongue 26 and lip 18, the stronger will be the latching action of the belt buckle.

Figure 3:
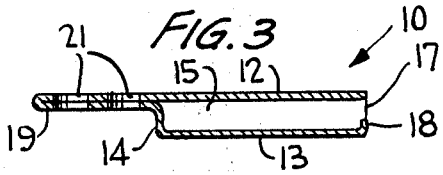
FIG. 3 is a view in section of the housing taken along lines 3—3 in FIG. 1.
Figure 7:
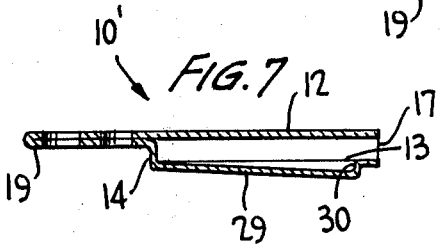
FIG. 7 is a view similar to that of FIG. 3 showing a modified housing portion of the belt.
Figure 8:
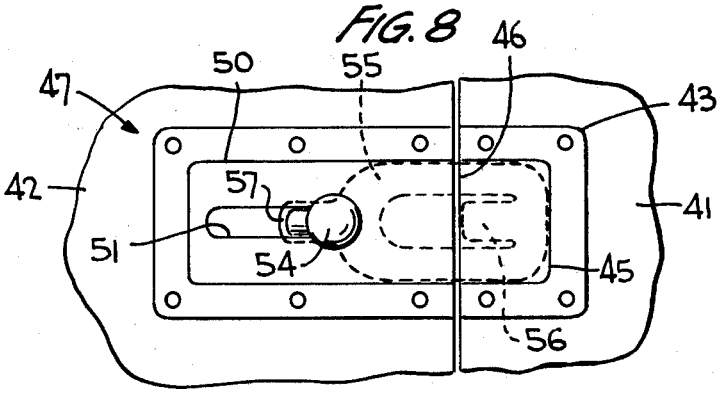
FIG. 8 is a front view in plan of a door latch according to the present invention.

An alternative housing member 10' is illustrated in FIG. 7 wherein like elements are designated with the same reference numerals as in FIGS. 1 and 3. In housing member 10' the bottom wall 13 includes a longitudinally extending recessed channel 29 which increases in depth from rear wall 14 towards forward end 17. Channel 29 terminates in a rearward facing shoulder 30 short of the forward end 17. Channel 29 is adapted to receive tongue 26 in the latched position of the buckle with the distal end of the tongue abutting shoulder 30. As noted above, it is preferable that this abutment be perpendicular and, in this regard, shoulder 30 may be angularly oriented accordingly.

The latching action employed in the belt buckle of FIGS. 1-7 is also useful in other closure mechanisms such as doors, windows, etc. An example of such a utilization is the embodiment of FIGS. 8-11. Two members 41 and 42 (such as a door and jamb, two window panes, two sliding panels, etc.) are illustrated and are movable relative to one another. Such movement can either be horizontal or vertical (as viewed in FIG. 9); that is, members 41 and 42 may slide apart in tracks or one of the members may be pivotable to move away from the other as in a conventional door and jamb combination. The latching arrangement includes a keeper 43 secured to one surface of member 41. Keeper 43 is shown made up of two parts, namely a bottom plate 44 and a top plate 45. Bottom plate 44 is a flat, generally rectangular plate having a lip 46 projecting a short distance away from member 41 along the forward edge of plate 44. In this regard, the forward edge of plate 44 is that edge closest to member 42. Plate 45 is a generally rectangular plate having a similar peripheral configuration to plate 44; however, plate 45 is provided with a recessed region defined on one side by the forward edge of plate 45. The other three sides of the recessed region are spaced from the corresponding edge of plate 45 so that a peripheral flange is defined by the non-recessed portion of plate 45 on these sides. This flange is secured to corresponding portions of plate 44 by means of rivets, screws, or the like. The recessed portion of plate 45 therefore defines a housing with plate 44, with the forward end of the housing being open. Lip 46, as described above, projects a short distance into the open forward housing end.

Another part of the latching arrangement of FIGS. 8-11 is a latch retainer 47 secured to member 42 directly opposite the forward end of keeper 43. Retainer 43 includes a flat, generally rectangular plate 48 having one surface secured directly to member 42 and having a rib 49 projecting from its upward surface and extending transversely along plate 48. The length of rib 49 is equal to or smaller than the corresponding dimension of the housing in keeper 43, the rib being aligned with that housing. Rib 49 is spaced a short distance from the forward end of retainer 47. The retainer additionally includes a cover plate 50 bounded on three sides by a flange portion which is secured to the periphery of plate 48 by screws, rivets, or the like. Interiorly of the flange portion cover plate 50 is recessed to define a retainer housing with plate 48. The retainer housing has an open forward end which faces the forward end of keeper housing 43. The widths of the keeper housing and retainer housing are substantially the same as are their depths; the retainer housing length is somewhat greater than the length of the keeper housing.

The top wall of retainer housing 47 is longitudinally slotted at 51 over the rearward part of its length. This slot is vertically aligned with a similar slot 52 in bottom plate 48 and an aperture 53 in member 42. The purpose of slots 51, 52 and 53 is to accommodate a handle 54 which functions as described below.

A latching member 55 is disposed for slidable movement between retainer housing 47 and keeper housing 43. Latching member 55 is similar in structure and operation to latching member 11 of FIG. 2 and includes an integral latching tongue 56 projecting from its inner rim. An integral actuator tail 57 extends from the outer rim of latching member 55 in the direction of retainer housing 47. Handle 54 extends through the thickness of actuator tail 57 and is secured thereto by means of welding, rivets, threaded engagement, or other suitable means.

Latching member 55 has two slidable positions. In a first or latching position, illustrated in FIGS. 8 and 9, the forward end of latching member 55 is fully inserted into keeper housing 43 and latching tongue projects down to abut lip 46. In this position, latching member 55 cannot be withdrawn from keeper housing 43 without buckling tongue 56. Members 41 and 42 cannot therefore be slid apart without buckling tongue 56. Further, latching member 55 serves as a bolt to prevent relative up or down movement (as viewed in FIG. 9) between members 41 and 42. In this position of member 55, actuator tail projects away from plate 48 in retainer housing 47 and the outer rim of member 55 is further away from plates 44 and 48 than is its inner rim.

Figure 9:
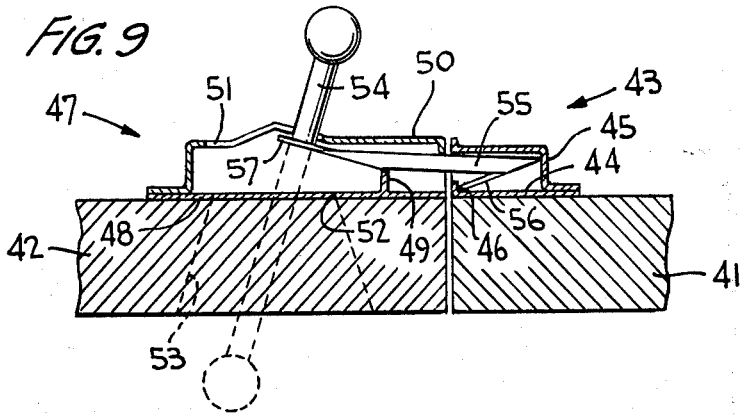
FIG. 9 is a side view in partial section of the door latch of FIG. 8 showing the latch in its latched position.
Figure 10:
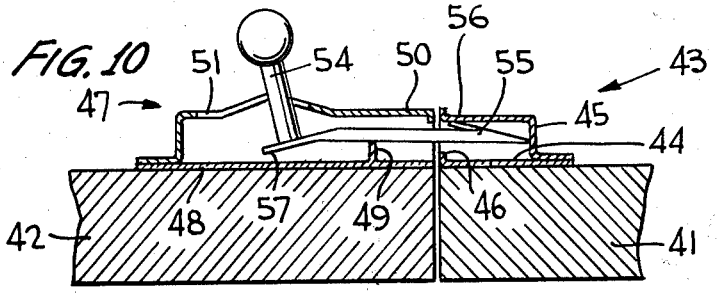
FIG. 10 is a view similar to that of FIG. 9 showing the latch in its unlatched position but still inserted into its keeper to prevent the door from opening.

FIG. 10 illustrates a position wherein the latching member 55 is fully inserted into keeper housing 43 (as in FIG. 9) but has been switched to its open or other stable position. In this position, the outer rim of member 55 is closer to the plates 44 and 48 than is its inner rim; actuator tail 57 projects toward plate 48; and, most importantly, the distal end of tongue 56 projects toward plate 45, away from lip 46. In this condition members 41 and 42 can be slid apart without interference by tongue 56. However, members 41 and 42 cannot be moved out of co-planar relationship in this condition since latching member 55 still resides in both the keeper housing and the retainer housing.

Figure 11:
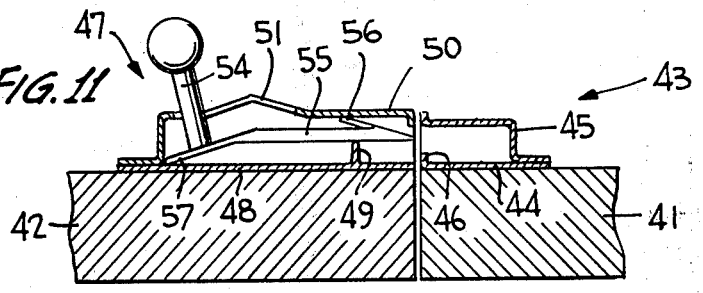
FIG. 11 is a view similar to that of FIG. 9 showing the latch withdrawn from its keeper.

In FIG. 11 the latching member is shown fully retracted from keeper housing 43 and in the same stable (i.e. non-latching) state as in FIG. 10. In this position the members 41 and 42 may either be slid apart or moved out of their illustrated co-planar relationship.

Actuation of latching member 55 to the different conditions will now be described. Assume that the initial position is as illustrated in FIG. 11 with the latching member fully retracted from keeper housing 43 and in its non-latching state. If handle 54 is moved to the right in slot 51, latching member 55 moves easily therewith until the forward end of the latching member abuts the rear wall of keeper housing 43, as seen in FIG. 10. At this point, further movement of handle 54 to the right is met with some resistance. Further movement of the handle, against this resistance, results in a small clockwise rotation of the latching member whereby actuator tail 57 is lifted upward and the forward end of the latching member tilts downward until it touches plate 44. Continued force to the right on handle 54 tends to continue the upwardly-directed force on tail 57 while the forward end of member 55 experiences an upward reactive force imparted by plate 44. A portion of latching member body intermediate the two ends makes contact with cover plate 50 which imparts a downwardly-directed reactive force at that portion. The net effect of the three forces is to bend the latching member which reacts by springing to its other stable position, illustrated in FIG. 9. In this position, tongue 56 abuts lip 46 to preclude removal of the latching member from the keeper housing. It is noted that cover plate 50 is bent or recessed to accommodate tail 57 in this position.

In order to open the latch, starting from the FIG. 9 position, handle 54 is pulled to the left. This causes tail 57 to pivot downward about the pivot point provided by rib 49 which imparts an upwardly-directed reactive force to the body of latching member 55. The forward end of the latching member pivots upward and experiences a downward reactive force applied by plate 45. The combination of downwardly-applied forces at its ends and an upwardly-applied force intermediate its ends causes latching member 55 to switch to its non-latching stable position shown in FIG. 10. Further movement of handle 54 to the left results in latching member 55 being fully withdrawn from keeper housing 43.

The latching arrangement illustrated in FIGS. 8–11, in its most essential form, requires only that tongue 56 be switchable between two positions to either be blocked or cleared for passage with respect to a lip or similar surface. Variations from the specific details of this embodiment may be employed without departing from the scope of the invention.

Figure 12:
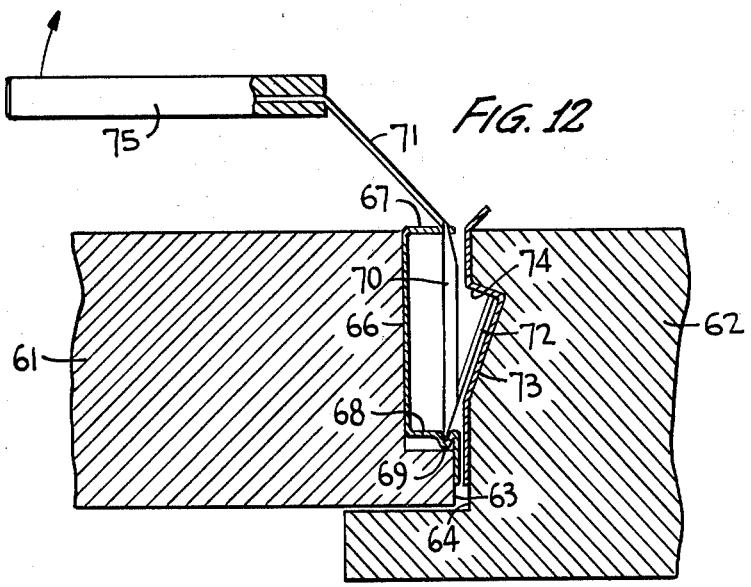
FIG. 12 is a side view in partial section of another door latch according to the present invention.

Another form of latching arrangement, useful for preventing movement between two members from a co-planar orientation, is illustrated in FIG. 12. The members to be latched are designated by 61, 62 and have respective surfaces 63, 64 which face one another in close proximity when the members are in the closed position. A portion of surface 63 is recessed to receive a generally rectangular cup-shaped support member 66 which is secured in the recess. The open end of support member 66 faces member 62. The outward facing side 67 of support member 66 is exposed and is provided with an aperture for purposes to be described below. The opposite side 68 of support member 66 has a recessed notch 69 disposed in alignment with the aperture in side 67. A bistable latching member 70, similar to members 55 and 11 described above, is disposed in support member 66 with one end supported in notch 69. The opposite end of member 70 includes an actuator tail 71 which projects through the aperture in side 67 to a location beyond the opposed surfaces 63 and 64. Latching member 70 includes a latching tongue 72 which, in the latched position shown, has its distal or free end projecting away from surface 63.

Surface 64 is provided with a recess of generally triangular cross-section, shaped to accommodate tongue 72 in the latched position. A plate 73, contoured to a portion of surface 64 including the triangular recess, is secured to surface 64 to serve as a keeper. Plate 73 includes one surface 74 which abuts the free or distal end of tongue 72 in a substantially perpendicular orientation when the latching member is in the illustrated latched condition. In this condition, movement of member 61 upward relative to member 62 is resisted by the reactive force applied longitudinally to tongue 72 by surface 74.

In order to switch the position of latch member 70, actuator tail 71 is rotated clockwise with the aid of handle 75. Actuator tail 71 pivots about the aperture in side 67, thereby attempting to pivot latching member 70 clockwise about that aperture. Since both ends of member 70 are restrained, the applied pivot force tends to bend member 70 until it snaps to its second or open position. In this position, the inner rim and tongue 72 are disposed within support member 66 so that tongue 72 clears surface 74. Member 62 can then be moved upward relative to member 62.

In describing the latching procedure, for all of the embodiments described herein, it has been stated, by way of example, that the disc 22, 55, 70 is in the open or unlatched stable position before being slid into housing 10, 43 or recess 73. This need not be the case. For example, latching member 11 may be slid into housing 10 with disc 22 in its latched position whereby the resilience of tongue 26 permits it to slide over lip 18. This sliding continues until the distal end of tongue 26 slides past lip 18 and snaps against bottom wall 13 to latch member 11 in the housing. This snapping action is sensed by the user as an indication that the belt is latched. Similarly, disc 55 can be slid in the latched condition into housing 43 whereby resilient tongue 56 slides past lip 46 and snaps against plate 44. A similar sliding-snapping entry of tongue 72 past surface 74 is possible.

It should also be noted that the tongues in each of the latching arrangements can be provided with a longitudinally-extending crimp or bend to provide increased stiffness against buckling or bending.

There are numerous other applications for the latch beyond those specifically described herein. For example, the latch can be used for briefcases, suitcases, handbags, trunks, and a wide variety of other devices requiring a latched closure.

The belt buckle arrangement of FIGS. 1–7 is particularly advantageous when used as a seat belt in planes, cars, etc. In such case elements 21 and 29 serve as connecting loops for different belt sections to be joined. The buckle is deployed with wall 12 of housing 10 facing the body of the wearer. Under such circumstances, as best seen in FIG. 6, forward acceleration of the wearer's body against housing wall and the exposed part of latch member 11 merely re-enforces the latched position of member 11. Moreover, it should be noted that there is no exposed push button, flap or other conventional seatbelt actuator which could be inadvertently actuated by the wearer's hand or an object on the wearer's lap. That is, some positive inward force (upward in FIG. 6) must be exerted on disc 22 and it is highly unlikely that such force could be applied inadvertently.

While I have described and illustrated various specific embodiments of my invention, it will be clear that variations of the details of construction which are specifically illustrated and described may be resorted to without departing from the true spirit and scope of the invention as defined in the appended claims.

I claim:

1. A latch mechanism for permitting selective engagement and disengagement of relatively movable first and second members, said latch mechanism comprising:

a positionally bistable member secured to said first member and comprising an endless band of spring-like material and having an outer rim and an inner rim which circumscribes a cut-out portion, said band having first and second stable positions wherein said inner rim is disposed on opposite sides respectively of said outer rim, said bistable member further including a latching tongue formed integrally with said endless band and projecting longitudinally from said band to terminate in a distal end, said tongue having first and second orientations which it assumes in said first and second stable positions, respectively, of said band;

surface means secured to said second member and positioned, when said first and second members are engaged, to abut said distal end of said tongue and prevent disengagement of said first and second members when said band is in said second stable position; and means for selectively applying bending forces to said bistable member to permit said bistable member to be selectively snapped between said first and second stable positions.

2. The mechanism according to claim 1, wherein said tongue in said second orientation, and with said first and second members engaged, abuts said surface means substantially perpendicularly to preclude disengagement of said first and second members, wherein attempts to disengage said first and second members results in a reactive force being applied by said surface means substantially longitudinally through said tongue.

3. The mechanism according to claims 1 or 2, wherein said tongue projects from said inner rim of said band.

4. The mechanism according to claim 3, wherein said surface means is part of a housing secured to said second member for receiving at least part of said band and said tongue when said first and second members are engaged.

5. The mechanism according to claim 4, wherein said housing has an open forward end for receiving said part of said band and said tongue in a first direction with said tongue, in said second orientation, having its distal end extending in a second direction generally opposite said first direction, and wherein said surface means is a surface facing said first direction.

6. The mechanism according to claim 5 used as a belt buckling arrangement and further comprising means for securing said bistable member and said surface means to opposite ends of a belt.

7. The mechanism according to claim 5 used as a door, wherein one of said first and second members is a movable door and the other of said first and second members is a jamb.

8. The mechanism according to claim 5, wherein said first and second members are each slidable panels.

9. The mechanism according to claim 5, wherein one of said first and second members is a panel which is slidable relative to the other of said first and second members.

10. The mechanism according to claims 1 or 2, wherein said band, in both said first and second positions and with said first and second members engaged, is positioned clear of said surface means and said second member and wherein only said tongue portion of said bistable member precludes disengagement of said first and second members.

11. A latching mechanism for permitting selective engagement and disengagement of relatively movable first and second members, said latching mechanism comprising:

a positionally bistable member secured to said first member and made of material having spring like properties to permit said bistable member to be selectively snapped to each of first and second stable positions; and means secured to said second member for abutting a portion of said bistable member, when said bistable member is in said first stable position and said first and second members are engaged, to preclude disengagement of said first and second members.

* * * * *